US012104372B2

(12) United States Patent
Bravo Valenzuela

(10) Patent No.: US 12,104,372 B2
(45) Date of Patent: Oct. 1, 2024

(54) STRUCTURAL WALL WITH A STRUCTURE EXOGENOUS TO THE LONGITUDINAL AXIS THEREOF FOR ENABLING THE INSIDE OF THE WALL TO BE FILLED ON SITE

(71) Applicant: Ricardo Jovino Bravo Valenzuela, Santiago (CL)

(72) Inventor: Ricardo Jovino Bravo Valenzuela, Santiago (CL)

( * ) Notice: Subject to any disclaimer, the term of this patent is extended or adjusted under 35 U.S.C. 154(b) by 0 days.

(21) Appl. No.: 15/578,087

(22) PCT Filed: Aug. 4, 2016

(86) PCT No.: PCT/CL2016/000043
§ 371 (c)(1),
(2) Date: Nov. 29, 2017

(87) PCT Pub. No.: WO2016/205968
PCT Pub. Date: Dec. 29, 2016

(65) Prior Publication Data

US 2018/0148923 A1 May 31, 2018

(30) Foreign Application Priority Data

Jun. 10, 2015 (CL) ..... 1619-2015

(51) Int. Cl.
*E04B 2/56* (2006.01)
*E04B 2/00* (2006.01)
(Continued)

(52) U.S. Cl.
CPC ..... *E04B 2/56* (2013.01); *E04B 2/00* (2013.01); *E04B 2/38* (2013.01); *E04B 2/40* (2013.01);
(Continued)

(58) Field of Classification Search
CPC ..... E04B 2/56; E04B 2/84; E04B 2/00; E04B 2/40; E04B 2/38; E04B 2/70; E04G 11/08
See application file for complete search history.

(56) References Cited

U.S. PATENT DOCUMENTS 1,607,114 A * 11/1926 Byrd ..... E04B 2/84 249/15
3,481,575 A * 12/1969 Artil ..... E04G 11/10 249/191
(Continued)

FOREIGN PATENT DOCUMENTS

CL 20100682 10/2010
JP H11350654 12/1999
(Continued)

*Primary Examiner* — Jessie T Fonseca
(74) *Attorney, Agent, or Firm* — Perry + Currier Inc.

(57) ABSTRACT

Structural wall with frame in wood, metal, plastic, polycarbonate or other resistant material that has no diagonals or chains strengtheners on its longitudinal axis or, in their absence, its structure is reticulated or articulated. This wall Gets the necessary rigidity through a structuring external to its longitudinal axis by different diagonal elements attached to studs or pillars and slabs, in way to allow a spill or padding to your interior with materials that you they give this wall performance of habitability, such as thermal insulation, acoustic insulation, thermal inertia and resistance the fire, using very cheap fillers as the soil of the place or simple mixtures as the with chaff mud, mud with expanded polystyrene, light concrete, soil with chip wood, soil and volcanic ash, or even the use of industrial waste as chopped tires or other items, some difficult to recycle; In short, you can use a wide range of fillers, depending on the specific need. This way of structuring allows, through the possibility of access at work inside a padded, improving ostensibly simple, fast and economic benefits of habitability of the walls, being
(Continued)

easily prefabricate and industrialize, and with a great variety of applications in homes and various types of buildings.

3 Claims, 20 Drawing Sheets

(51) Int. Cl.

| | |
|---|---|
| ***E04B 2/38*** | (2006.01) |
| ***E04B 2/40*** | (2006.01) |
| ***E04B 2/70*** | (2006.01) |
| ***E04B 2/84*** | (2006.01) |
| *E04G 11/08* | (2006.01) |

(52) U.S. Cl.
CPC ..... *E04B 2/70* (2013.01); *E04B 2/84* (2013.01); *E04G 11/08* (2013.01)

(56) References Cited

U.S. PATENT DOCUMENTS 4,117,639 A * 10/1978 Steenson ..... E04C 2/044 52/223.6
4,574,550 A * 3/1986 Maschhoff ..... E04B 2/40 52/309.12
4,702,053 A * 10/1987 Hibbard ..... E04C 2/044 52/309.12
4,835,928 A 6/1989 Scott
4,918,897 A * 4/1990 Luedtke ..... E04B 1/16 52/657
6,523,323 B2 * 2/2003 Worley ..... E04G 11/14 249/191
7,337,591 B2 * 3/2008 Molina ..... E04G 11/10 52/425
2004/0094689 A1 * 5/2004 Rose ..... E04G 17/001 249/194
2006/0277854 A1 * 12/2006 Egan ..... E04B 1/70 52/302.3
2007/0193169 A1 * 8/2007 Emblin ..... E04B 1/161 52/690
2009/0165411 A1 * 7/2009 Schiffmann ..... B29C 44/1285 52/309.1
2013/0074432 A1 * 3/2013 Ciuperca ..... E04B 1/21 52/309.4
2014/0332658 A1 11/2014 Ciuperca
2015/0211245 A1 7/2015 Foster
2015/0322664 A1 * 11/2015 Manning ..... E04B 5/32 52/742.15
2016/0369501 A1 * 12/2016 Meza ..... E04B 2/84

FOREIGN PATENT DOCUMENTS

JP 2000303614 10/2000
JP 20110746645 4/2011

* cited by examiner

STRUCTURAL WALL WITH A STRUCTURE EXOGENOUS TO THE LONGITUDINAL AXIS THEREOF FOR ENABLING THE INSIDE OF THE WALL TO BE FILLED ON SITE

DESCRIPTIVE REPORT

The present invention is referred to a structural wall with elements cross-linked, exogenous or not to the longitudinal axis of the wall, allows the dumping of their interior fill in the work field. This is applicable to a large number of variants, thicknesses and materials. The use of the present invention allows to industrialize the placement of fillings in the work place to walls that previously could not be filled due to the internal structural elements.

STATE OF THE ART

Construction systems of walls and partitions of wood, metal or other material, that have pillars or studs, diagonal strengtheners, screeds and chains in the same axis are vastly known. Usually, between this lattice is placed some stuffing (expanded polystyrene, glass wool, polyurethane foam or other materials) to provide insulation, prior to closing or lined one side of the wall.

Among the known walls of the State of the art which have some similarity with the wall of the presented invention, there is a known document US 2004237425 (Worrell, Szerdi) from the year 2004, that has a great complexity and variety of building elements, whose interior is filled after to the placement of vertical slats, side mesh, insulation in both sides and horizontal reinforcement bars. The fundamental differences of the present invention with the wall of American invention of the year 2004, lie in that the wall of the present invention has pillars or essential Interior studs to transmit the loads to the base of wall and fixate the coating and can be built in thicknesses well below those mentioned in the patent of Worrell, (of 40 cm minimum). The wall of the present invention, also pre-fabricable, which clearly does not occur with the wall of the invention of Worrell.

Another document, CL1416-92, from an abandoned request for patent in 1992, reported a panel self-supporting (not a supporting wall) to be placed on base, that presenting no pillars (one speaks of tables that reinforce the panel down the middle) diagonals or chains inside, but does not mention the way how is structured, and delivers a layer of expanded polystyrene and its metal and rear mesh lining stucco, the mission of structuring it. Clearly there are obvious and important differences between this invention of a self-supporting panel and the present: A structural wall capable of receiving loads. It is important to note that the differences are not only of materials used or the provision thereof, but also conceptual; i.e., the basic concept or inventive unit of the filed invention is not present in the patent application abandoned.

The Chilean patent CL-49055 (from the same author of this invention, Ricardo Valenzuela Bravo) of the year 2013, which although it has several common elements that are used or applied in conjunction with the present invention designed wall, does not have incorporated the invention of reticulated structure and the Elimination of internal bias that constitutes the key of the present invention.

The CL-49055 wall, is a structure of wood impregnated with plinth of expanded polystyrene and cylinders of concrete in its base, which is filled with branches or adobes and not filling in bulk as is the case of the present invention.

SUMMARY OF THE INVENTION

The present invention has a clear concept and is due to a single inventive unit defined, that it differs sharply from any other wall known previously: A wall with crosslinked or exogenous structural elements to the longitudinal axis Wall which allows its interior filling, on-site disposal. This is applicable to a large number of variants and alternatives of walls, so the wall using this invention has the possibility to be built in an infinite number of thicknesses. The use of the present invention allows to industrialize the placement of fillings in the site of the work.

DESCRIPTION OF THE TECHNICAL PROBLEM TO BE RESOLVED

The invention of the wall of the present invention solves the following problems:

1. Solves the problem of lack of mass in the construction: the mass or physical weight is a thing that gives the House its stability or thermal inertia, as well as thermal, acoustic insulation and fire resistance. This implies a major conversion of a temporary or emergency house to a final house conversion.
2. Expanded polystyrene which acts as or in lieu of the above Foundation, isolating or separating the ground of the wall, avoiding thermal bridges and the rise of moisture by capillary action.
3. Placement of cylinders of concrete of 3 to 5 cm of thickness on the basis of those pillars that transmit greater burden to the ground or "plates" (in order to distribute it and avoid the collapse of the pillars) solves, replaces or prevents the making of a Foundation.
4. The distribution of the structural elements allows that its interior can be filled with materials that provide different qualities: thermal, acoustic, fire and thermal inertia resistance.
5. Produces significant savings in transport of materials; the soil used for filling is obtained from the same spot. By the nature of their materials, the minimally invasive with the surroundings and the friendly with the environment, this wall, with all property, you must call "ecological", since its main components are renewable materials such as the wood and the floor.
6. Gives quality solution to construction problems resulting from natural disasters, because it allows the re-use of materials from the demolition of damaged dwellings and the use of low-cost materials and easy obtain.
7. Solves problems of labor since the construction of this wall does not require greater specialization and their learning is simple and also innate to a lot of cultures that have built similar walls since time immemorial.
8. Solves a problem of time, since it is highly industrialized (can be prefabricated and used in efficient and high-performance machinery) and the filler material can be transported in bulks or in a concrete truck.
9. Solves a problem of limitation of construction by weather station since, for example, in comparison to adobe, you need enough sun and water in periods in which water is usually scarce, this system does not have this limitation and can be used in any era.
10. Solves problems of logistics since it uses very few materials and consequently also too little transportation.

11. This constructive solution leaves a very low carbon footprint, this implies a very low energy consumption and minimal pollution.
12. Low cost, high quality and great qualities of insulation and livability benefits enable the construction of larger and better quality, same value, compared with the traditional construction.
13. Reduces significantly the final cost of construction, for the low price of its constructive elements and the use of filling materials that is economic.
14. As it is a meccano kind, foldable, modular and stackable, space-saving, facilitates the storage and saves transportation.
15. Is refillable at the site of the work once located the vertical parameters externals and internals, what is not possible in traditional walls.
16. In comparison with the traditional building systems, reinforced masonry, this wall only uses a fraction of the sand and aggregates what is required, and in places of little rain can even not take cementitious stucco. This is a very important factor, since sand is currently a very scarce on the planet as a material and many countries do not count with it anymore.

BRIEF DESCRIPTION OF THE DRAWINGS

A more complete appreciation of this disclosure and many of the attendant advantages thereof will be readily obtained as the same becomes better understood by reference to the following detailed description when considered in connection with the accompanying drawings, wherein.

NOMENCLATURE OF THE ELEMENTS OF WALL A

Figure 1A:
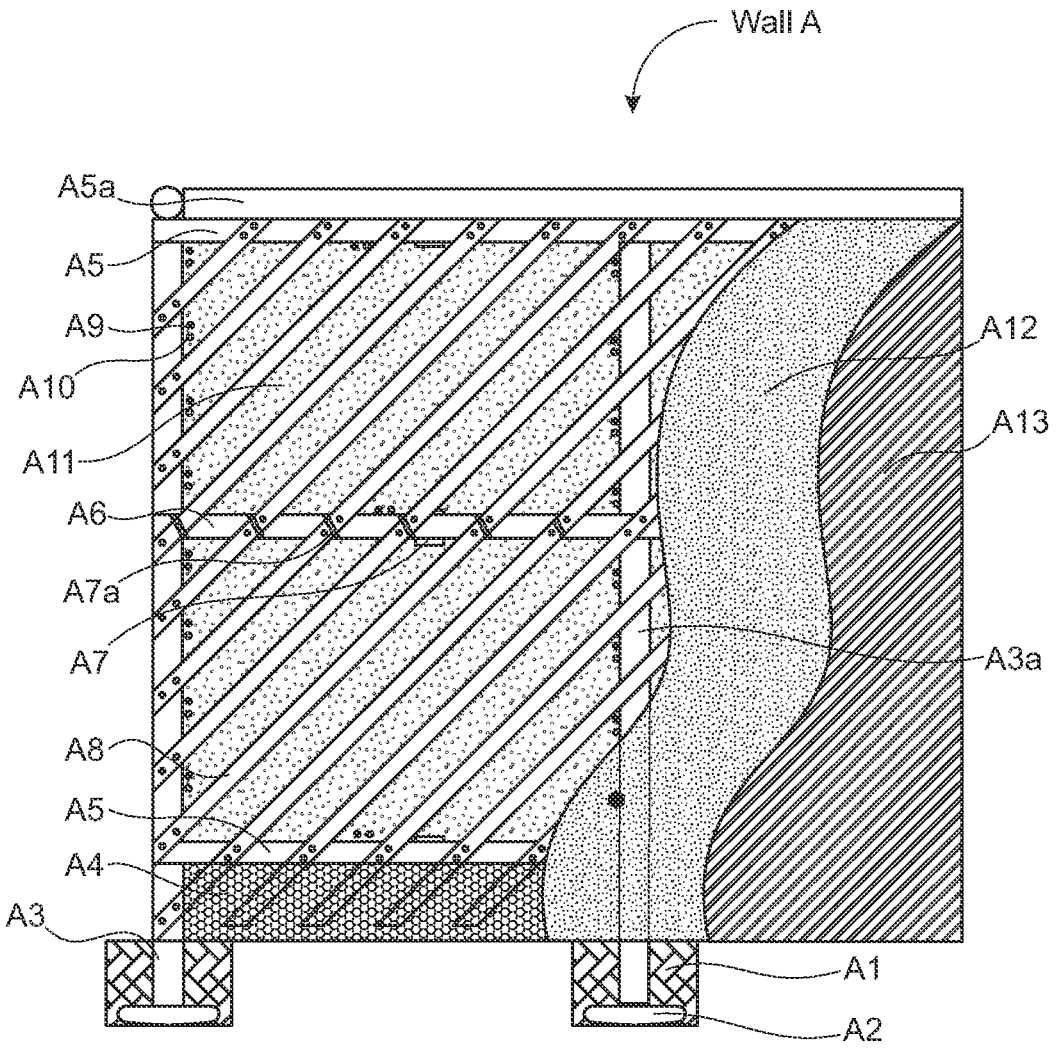
FIG. 1A is an elevation view of a structural wall, namely Wall A, in accordance with a first embodiment of the present disclosure.

A1—Foundation.
A2—Concrete cylinder.
A3—Pillars.
A3*a*. Pillar supplements.
A4—Foundation block.
A5—Bottom plate (and/or top plate).
A5*a* Sill
A6 Lockstitch intermediate
A7 Barrier
A7*a*—Moorings.
A8—Diagonal stiffening elements.
A9. Formwork separator strip.
A10 Pass tube for tie-down bolt
A11. Filling mixture.
A12—Cladding.
A13. Wall finish.
AM—Temporary formwork

NOMENCLATURE OF THE ELEMENTS OF WALL B

B1—Foundation.
B2—Concrete cylinder.
B3—Pillars.
B3*a*. Pillar supplements.
B4—Foundation block.
B5—Bottom plate (and/or top plate).
B5*a*Sill
B6 Lockstitch intermediate
B7 Barriers
B7*a*Wire ties
B8—Diagonal stiffening elements.
B9. Formwork separator strip.
B10 Pass tube for tie down bolt
B11—Filling mixture.
B12. Cladding.

B13. Wall finish.
BM. Temporary formwork.

NOMENCLATURE OF THE ELEMENTS OF WALL C

C1—Foundation.
C3—Pillars.
C4. Foundation block.
C5. Bottom plate (and/or top plate).
C5*a*Sill
C6. Intermediate plate.
C7 Barrier
C11. Filling mixture.
C12—Cladding.
C13. Wall finish.
C14—Plinth.
C15—Slats.
C16—Cladding fixing system.
C17—Polyethylene film.
C18 Connecting piece
C19. Wall to pavement anchoring.

NOMENCLATURE OF THE ELEMENTS OF WALL D

[D1—Foundation.
D3. Pillars.
D3*b*. Rib.
D4. Foundation block.
D11. Interior filling of the wall made of clay with straw, clay with expanded polystyrene and/or other components depending on the need for insulation.
D12—Cladding.
D13. Wall finish.
D18. Reinforcements.
D19. Floor anchoring system.

NOMENCLATURE OF THE ELEMENTS OF WALL E

E1. Foundation.
E3*b*. Veined or reinforcement of the pillar in the case of continuous wall.
E4. Foundation block.
E11—Filling mixture.
E12. Cladding.
E13. Wall finish.
E18. Reinforcements.
E19. Floor anchoring system.
E20—Articulated elements.
E21. Folding modular block.
E22—Fixing clip between modules.
NOMENCLATURE OF THE ELEMENTS OF WALL F
F1—Foundation.
F4 Foundation block.
F5—Crowning plate.
F10 Formwork spacer tubes
F11 Filling mixture
F12 Plaster
F13.—Wall finish.
F19.—Floor anchoring system.
F20.—Articulated elements.
F21.—Folding modular block.
F22—Fixing clip.
F23.—Vertical and diagonal ribs.
F24.—Tensioners.
FM.—Temporary formwork.

DETAILED DESCRIPTION OF THE INVENTION

The present invention relates to a structural wall and consists of replacement of the elements typical to strength a wall (pillars, diagonals and chains) that are traditionally and according to the State of the art, in the longitudinal axis of the wall and preventing the dumping or placing of your filling into work, by structural elements cross-linked strengtheners that allow the passage of this filler inside the wall to full-width long and high, allowing its discharge into work; or by a structuring external to the longitudinal axis of the wall which transforms its coating structure strengthener with same goal: allowing the filling or discharge of different types of mixtures to the inside of the wall to obtain qualities, of thermal, acoustic insulation, thermal inertia, and fire resistance. The above properties can be obtained at a minimal cost through the use of clay; However, the invention enables the use of a multiplicity of fillings such as concrete with pearls of polystyrene, EPS beads soil, volcanic ash, sand, soil mixtures with cement, sawdust, chips of wood, sand or any available material that provides features to the wall required.

Figure 2A:
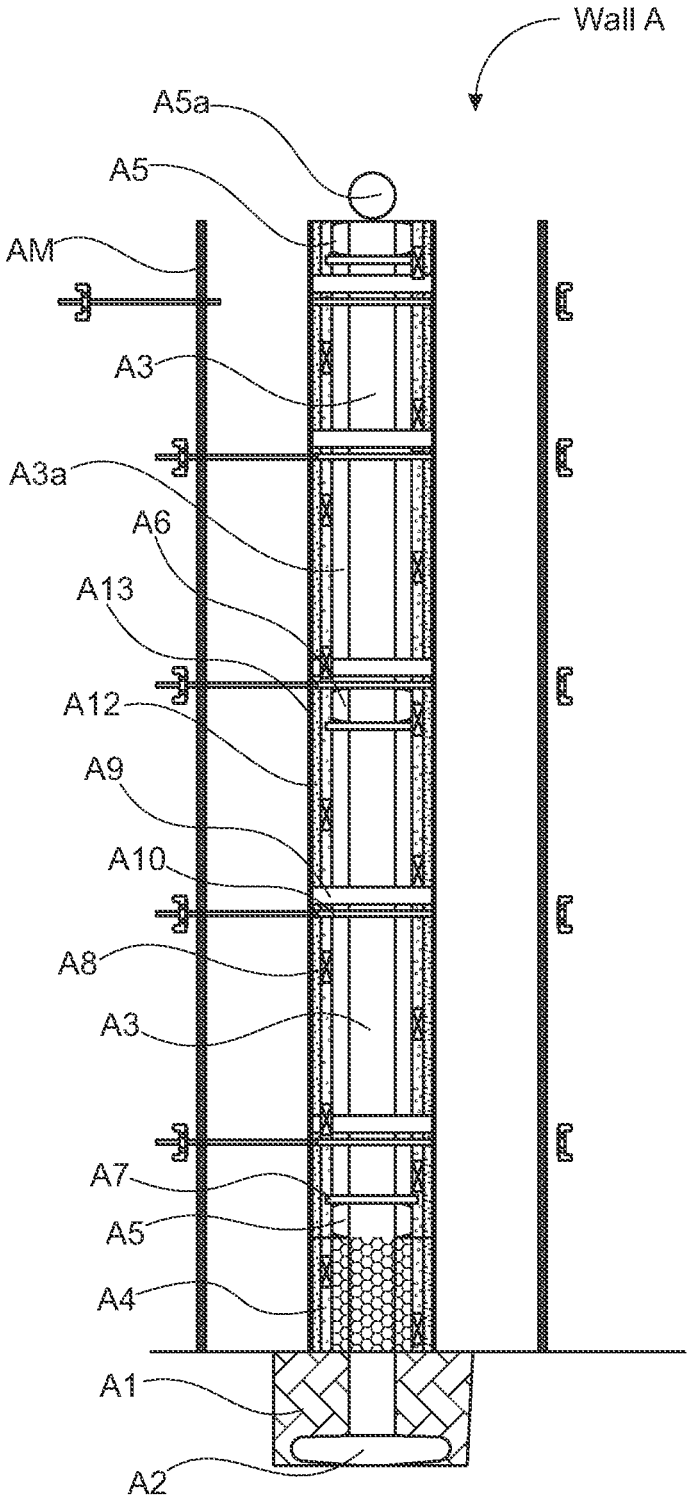
FIG. 2A is a view showing a vertical section of the Wall A in accordance with the first embodiment of the present disclosure.
Figure 3A:
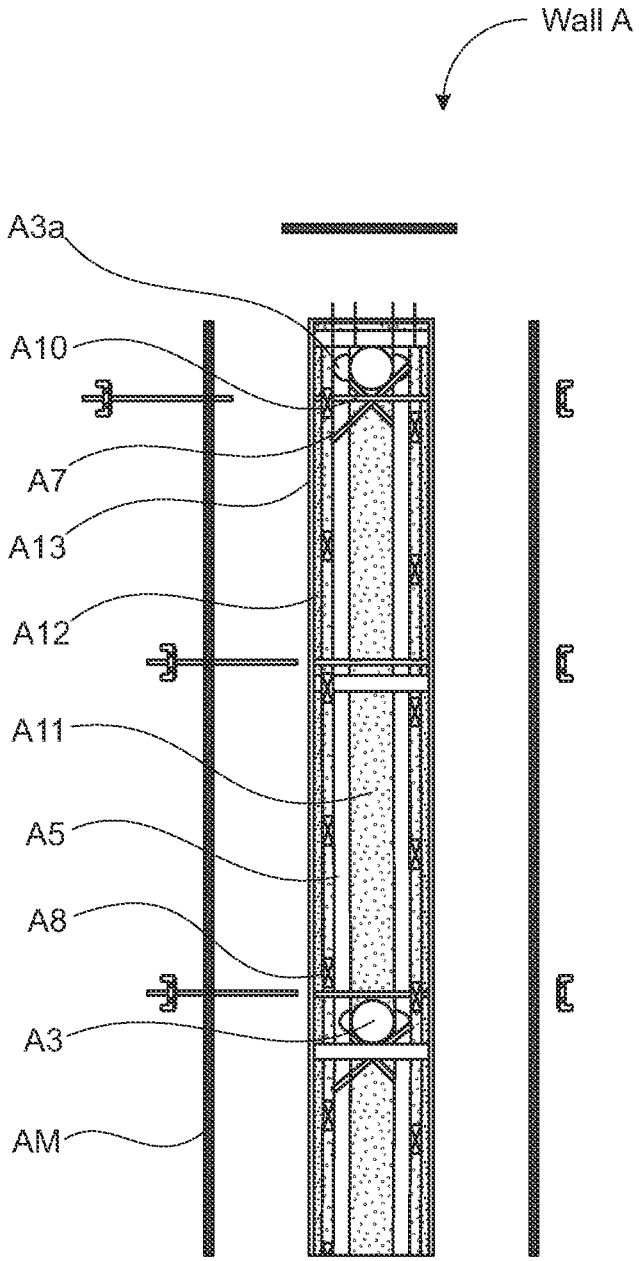
FIG. 3A is a view showing a horizontal section of the Wall A in accordance with the first embodiment of the present disclosure.

The present invention has a single inventive unit but applies to an undetermined number of walls and variety of materials. Six cases will be detailed:

The alternative A wall, represented by FIGS. 1A, 2A and 3A, showing the application of the present invention, a wall of individual pillars located on the axis of the wall.

Figure 1B:
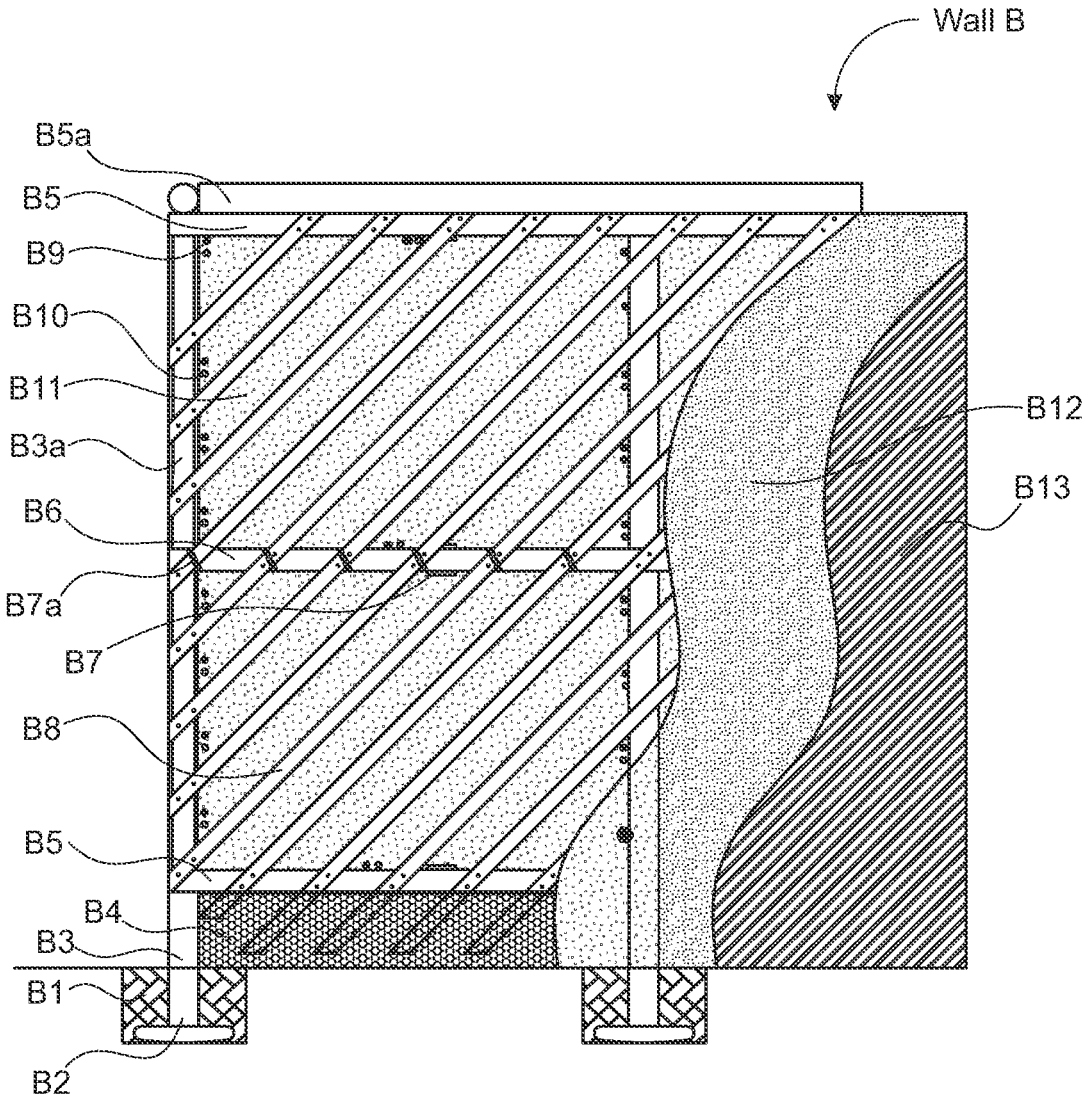
FIG. 1B is an elevation view of a structural wall, namely Wall B in accordance with a second embodiment of the present disclosure.
Figure 2B:
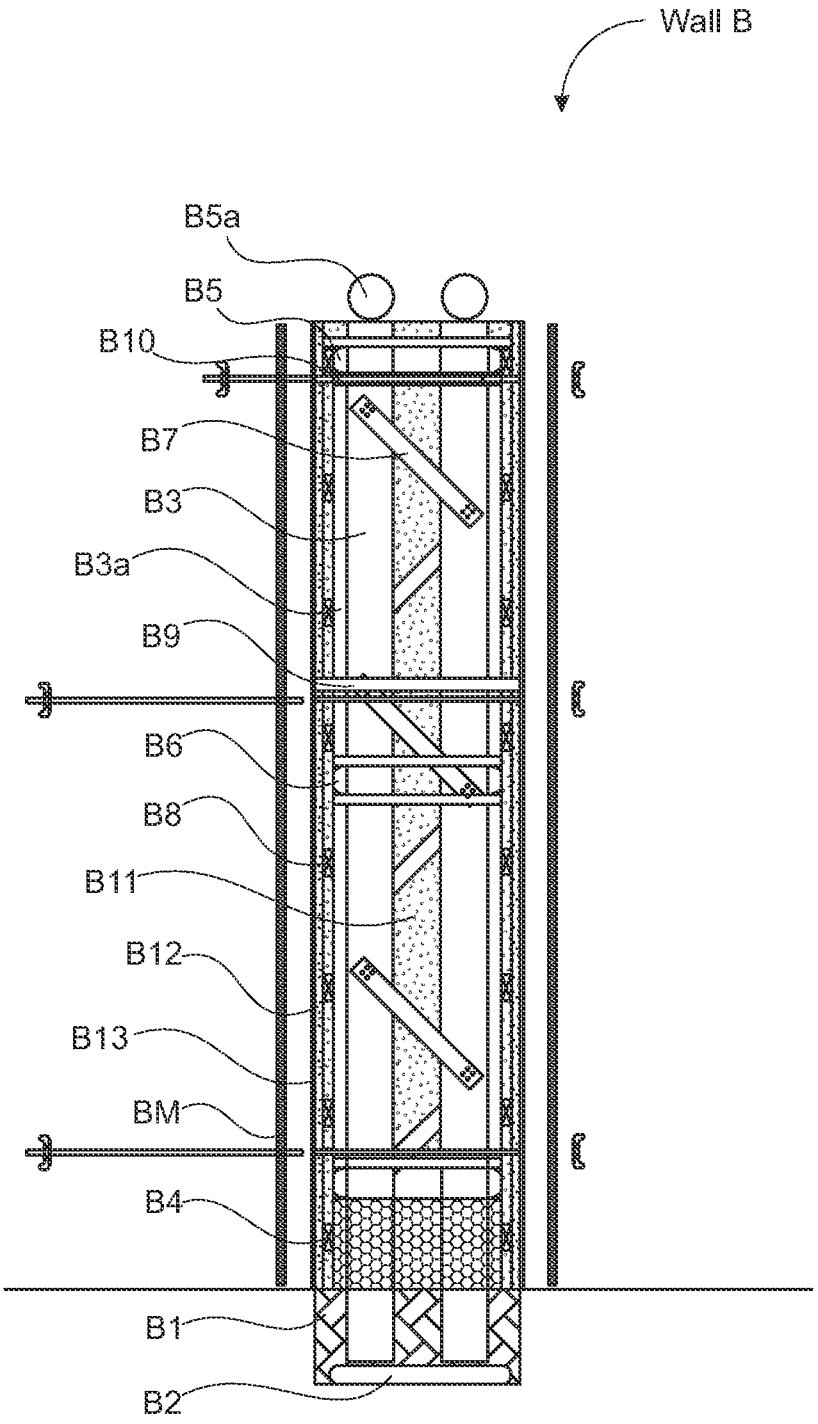
FIG. 2B is a view showing a vertical section of the Wall B, in accordance with the second embodiment of the present disclosure.
Figure 3B:
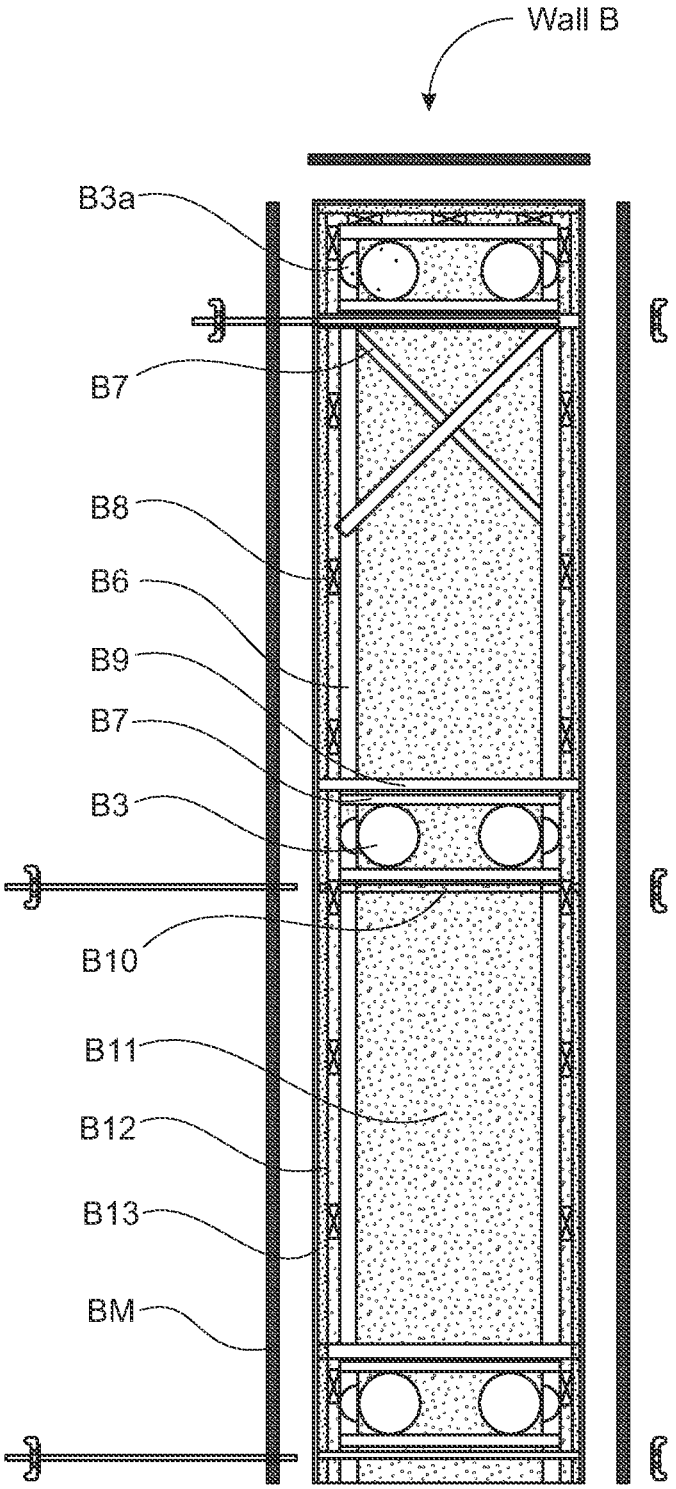
FIG. 3B is a view showing a horizontal section of the Wall B, in accordance with the second embodiment of the present disclosure.

The alternative wall B, represented by FIGS. 1B, 2B and 3B, which shows the application of the present invention a wall commonly thicker, built by more than one pillar in the same transverse axis (pillar doubles, triples, etc.) cross-linked or willing so to allow the free passage of the stuffing inside of the wall.

Figure 1C:
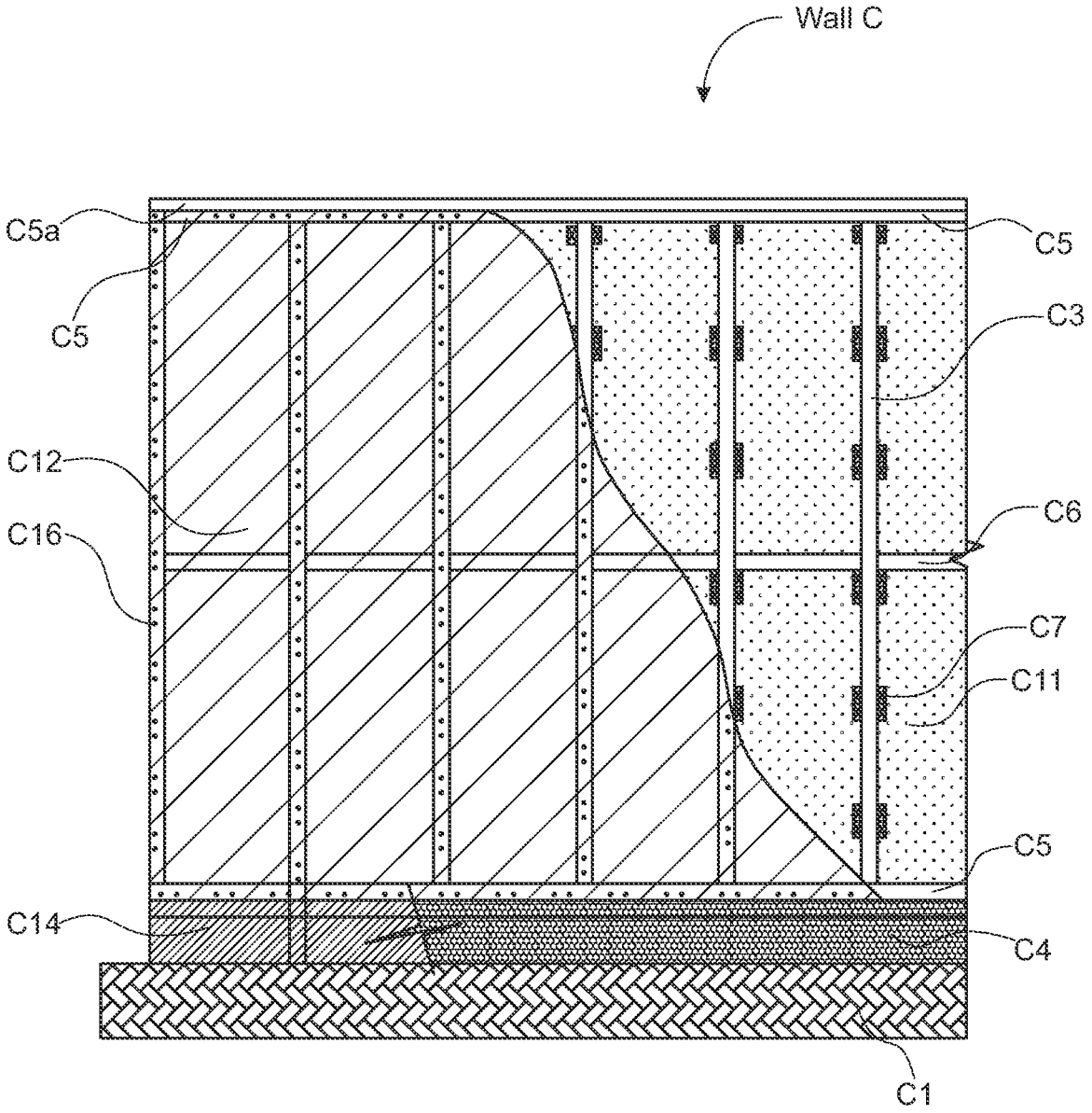
FIG. 1C is an elevation view of a structural wall, namely Wall C, in accordance with a third embodiment of the present disclosure.
Figure 1D:
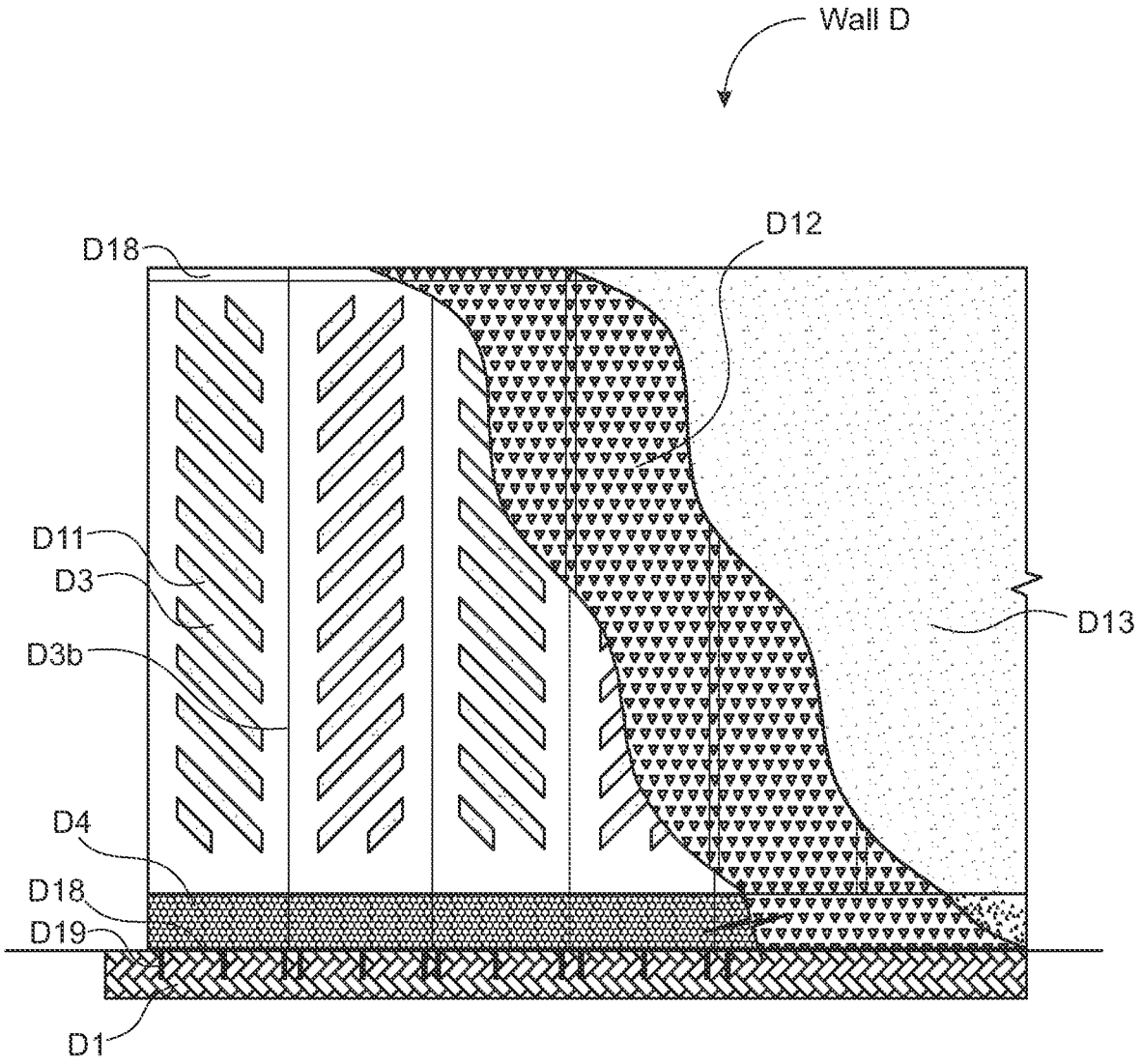
FIG. 1D is an elevation view of a structural wall, namely Wall D, in accordance with a fourth embodiment of the present disclosure.
Figure 1E:
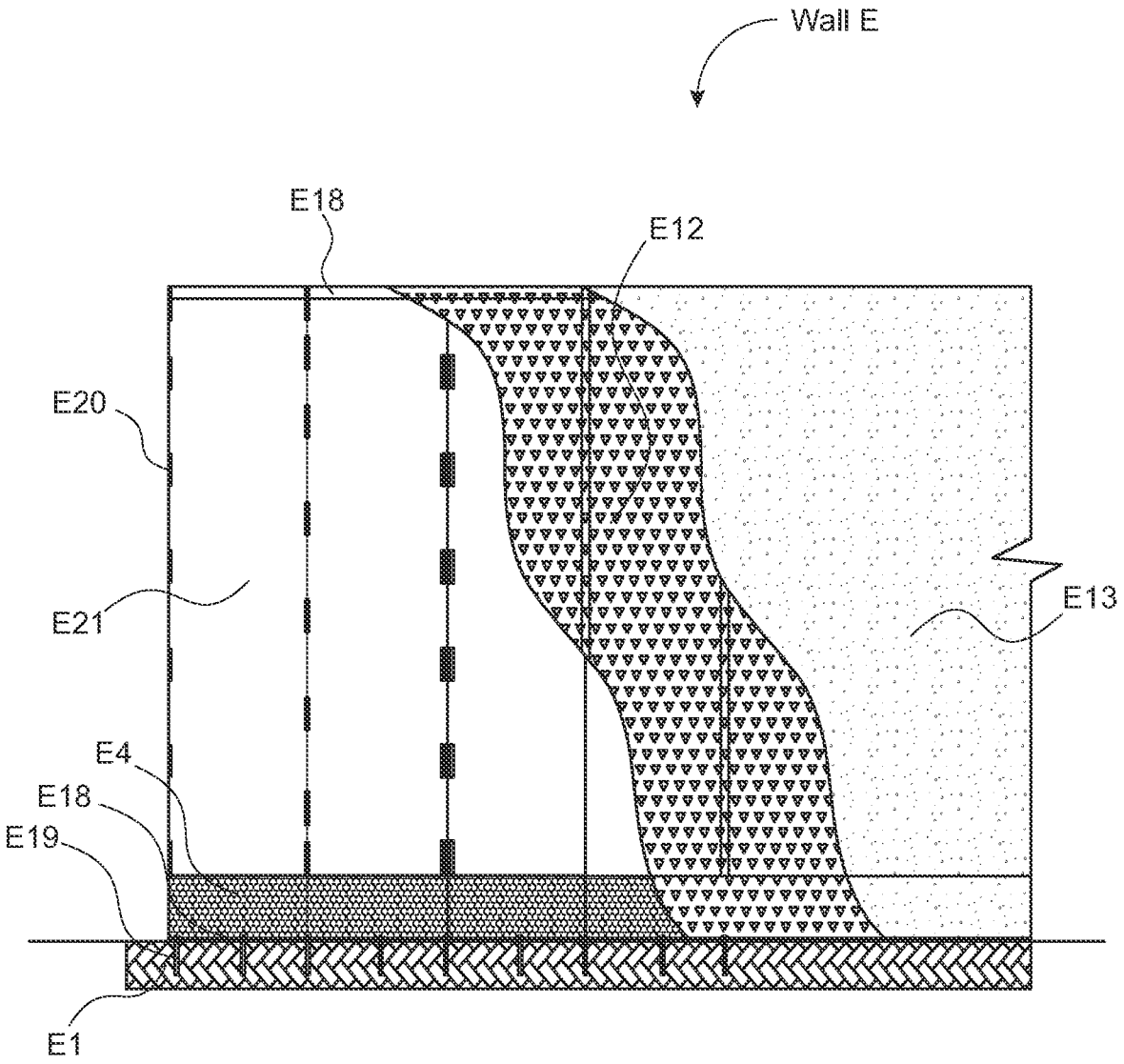
FIG. 1E is an elevation view of a structural wall, namely Wall E, in accordance with a fifth embodiment of the present disclosure.
Figure 1F:
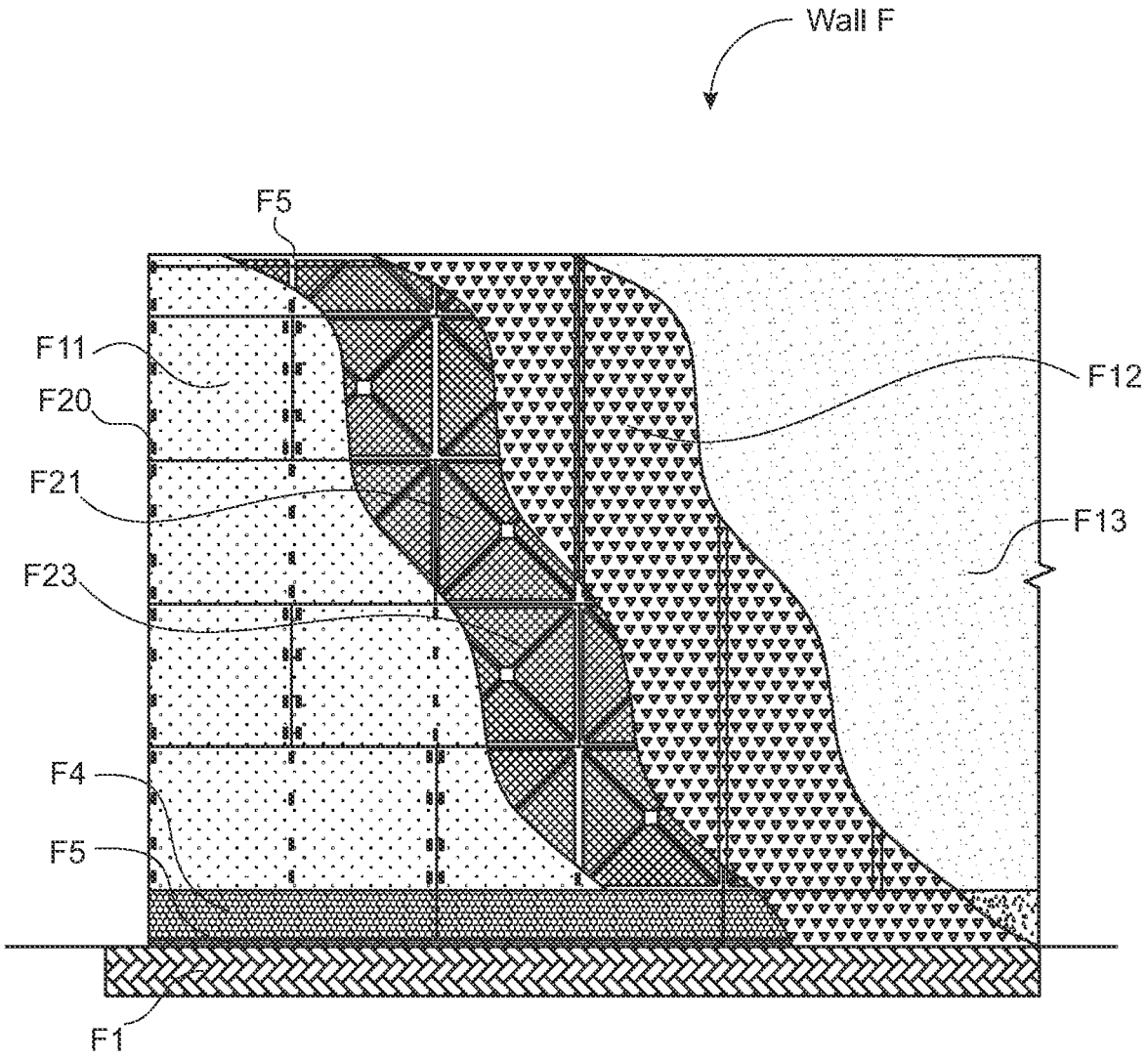
FIG. 1F is an elevation view of a structural wall, namely Wall F, in accordance with a sixth embodiment of the present disclosure.
Figure 2C:
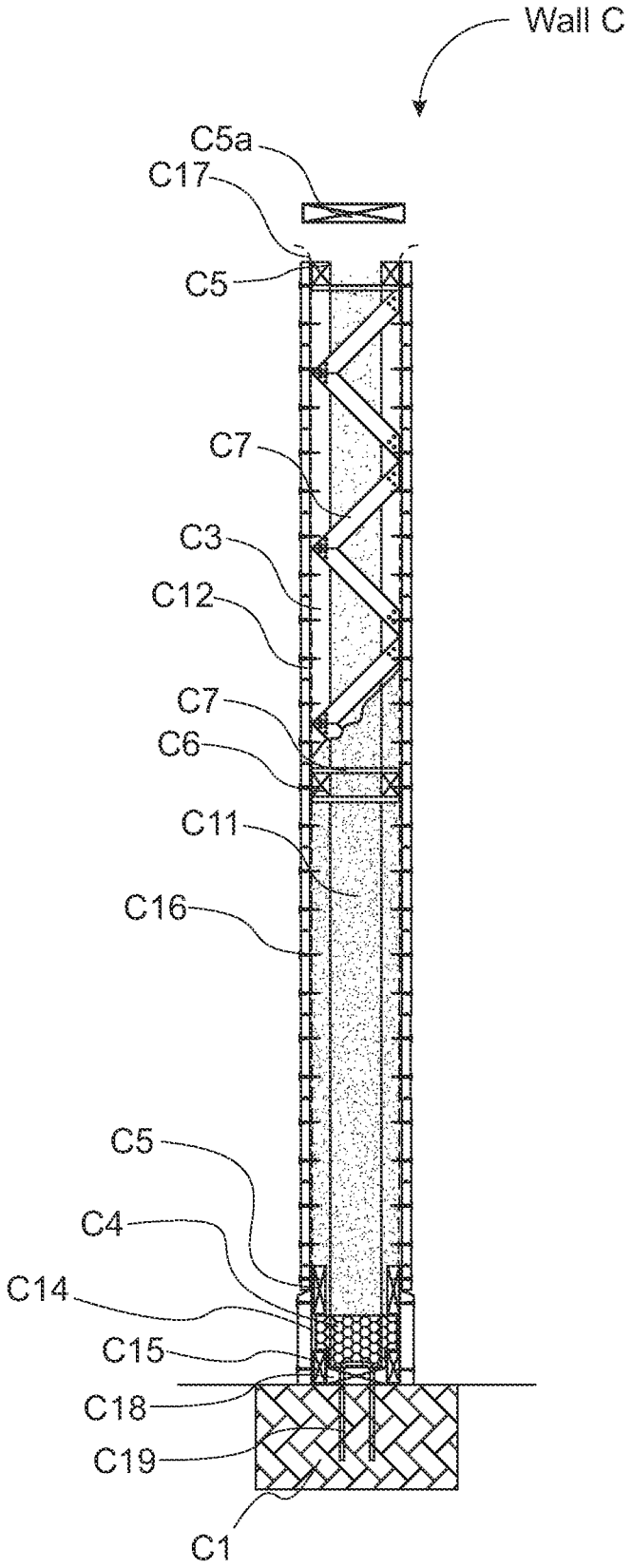
FIG. 2C is a view showing a vertical section of the Wall C, in accordance with the third embodiment of the present disclosure.
Figure 2D:
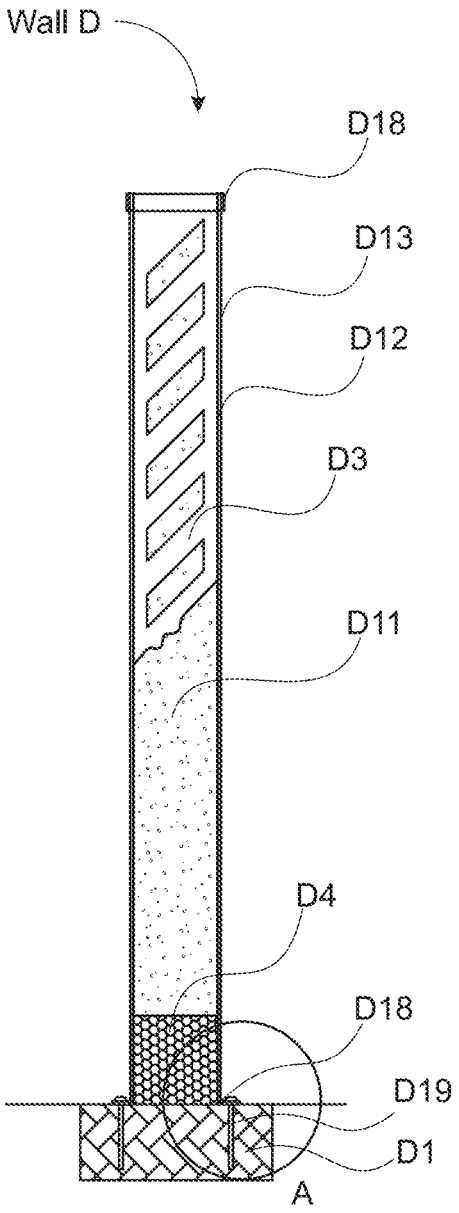
FIG. 2D is a view showing a vertical section of the Wall D, in accordance with the fourth embodiment of the present disclosure.
Figure 4A:
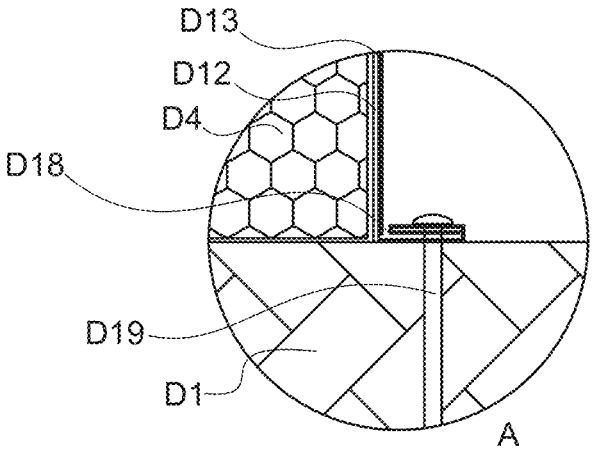
FIG. 4A is a view showing details of anchorage of the Wall D to a pavement, in accordance with the fourth embodiment of the present disclosure.
Figure 2E:
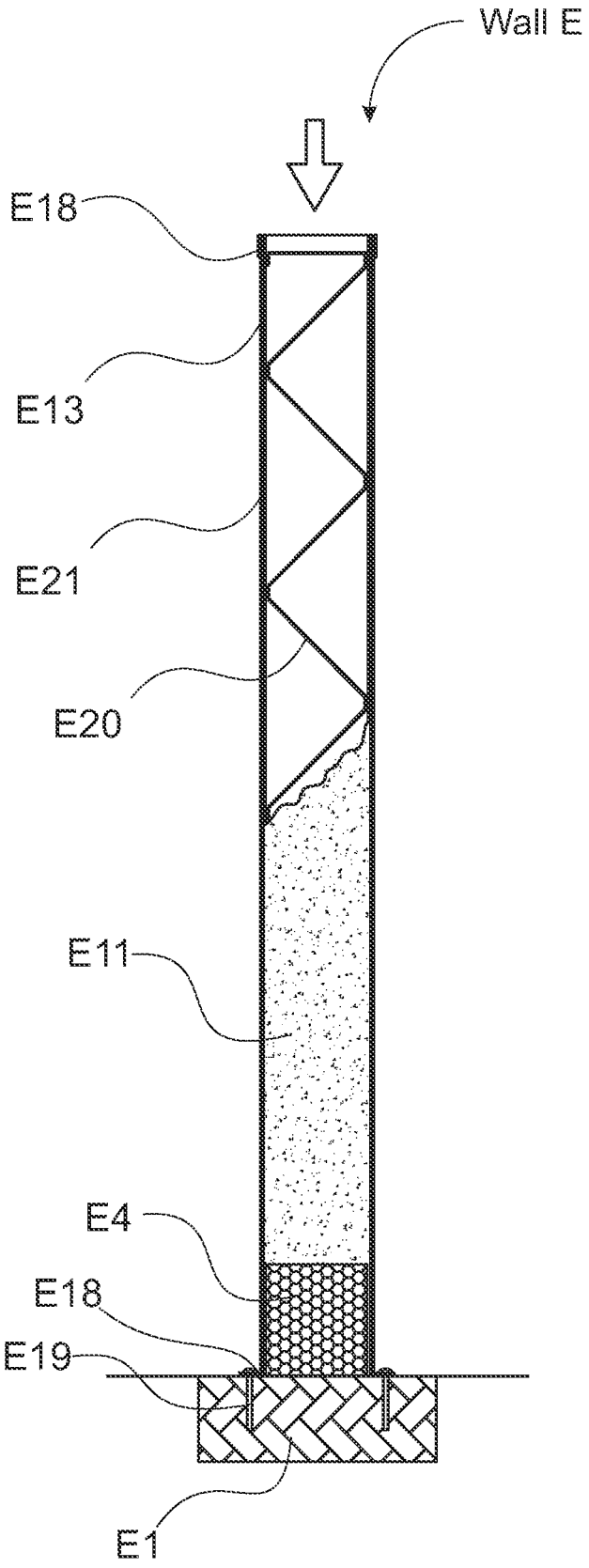
FIG. 2E is a view showing a vertical section of the Wall E, in accordance with the fifth embodiment of the present disclosure.
Figure 2F:
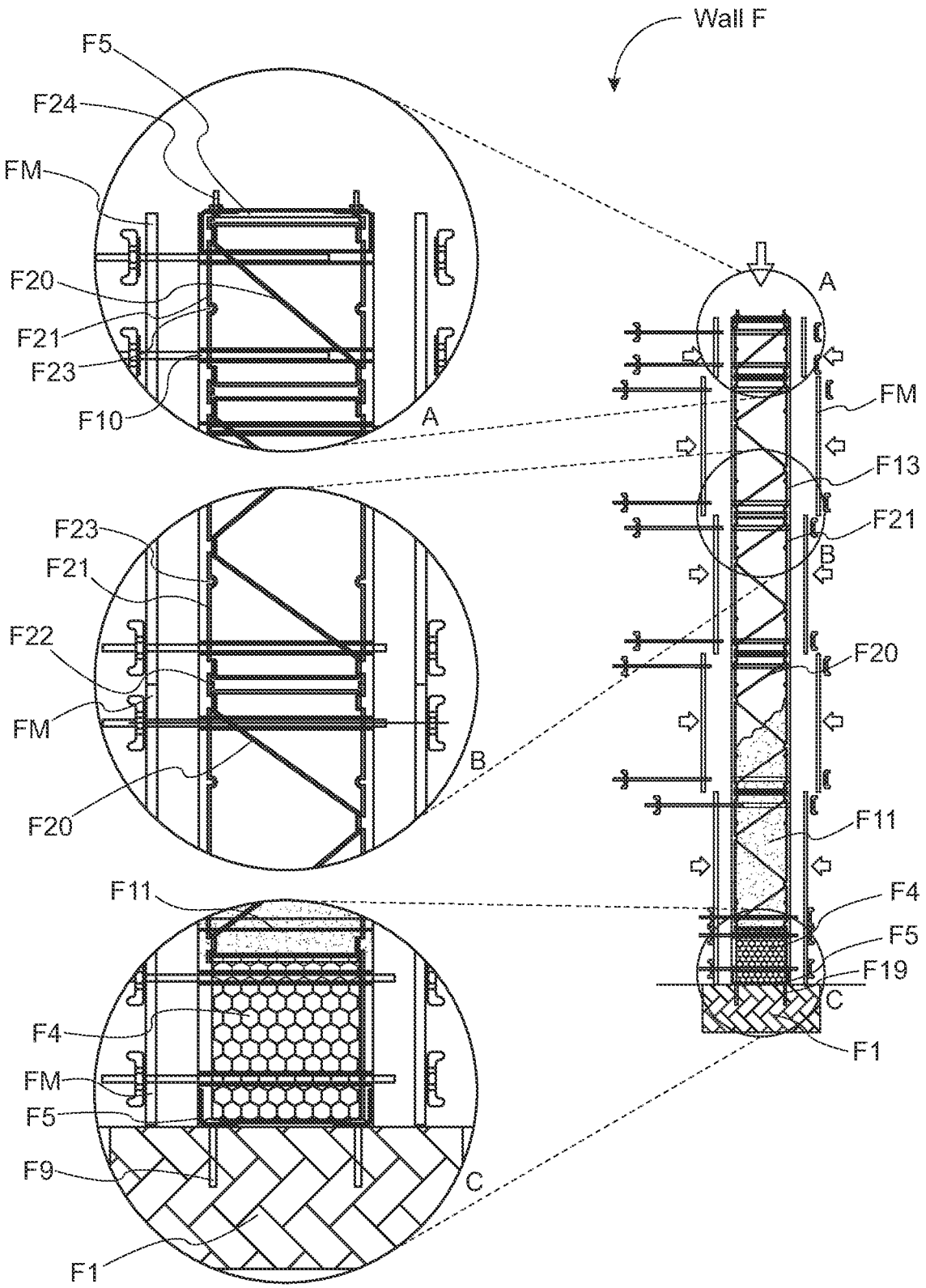
FIG. 2F is a view showing a vertical section of the Wall F, in accordance with the sixth embodiment of the present disclosure.
Figure 3C:
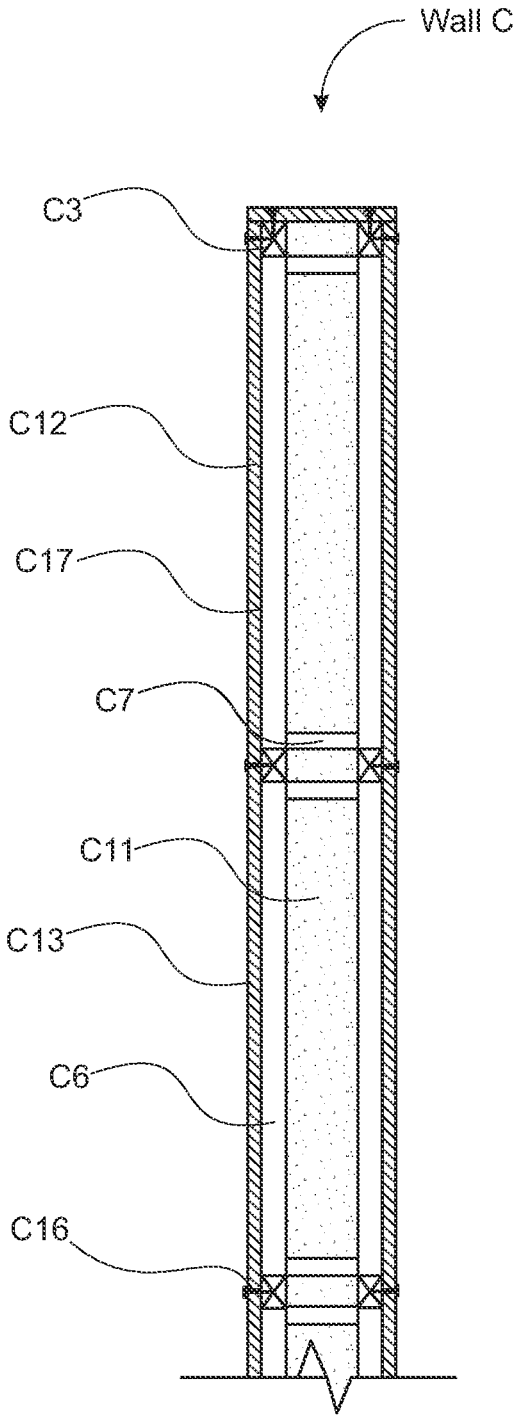
FIG. 3C is a view showing a horizontal section of the Wall C, in accordance with the third embodiment of the present disclosure.
Figure 3D:
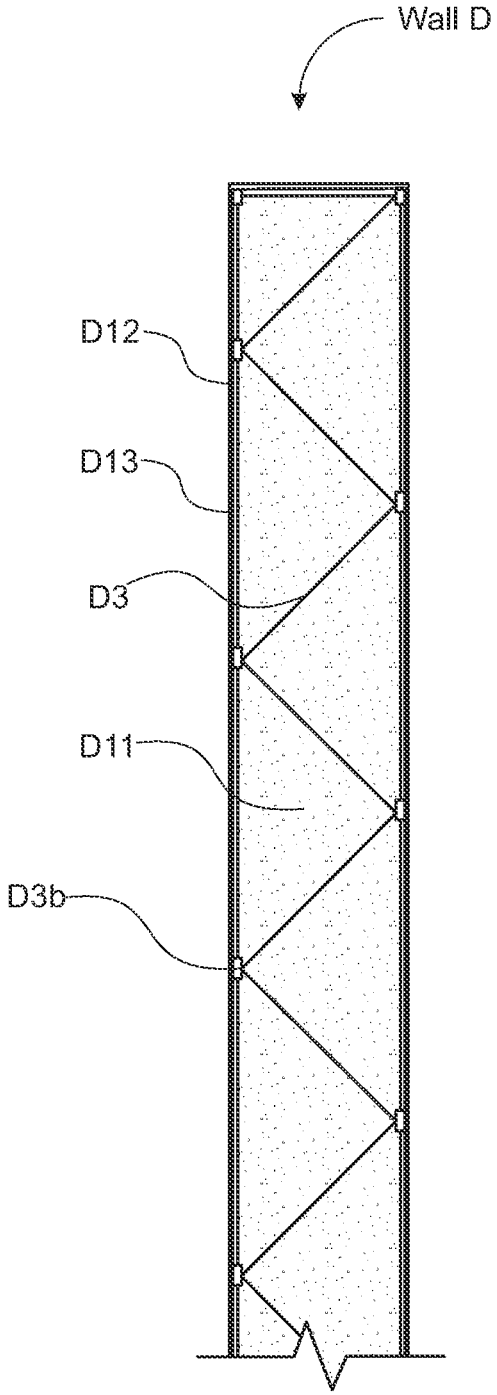
FIG. 3D is a view showing a horizontal section of the Wall D, in accordance with the fourth embodiment of the present disclosure.
Figure 3E:
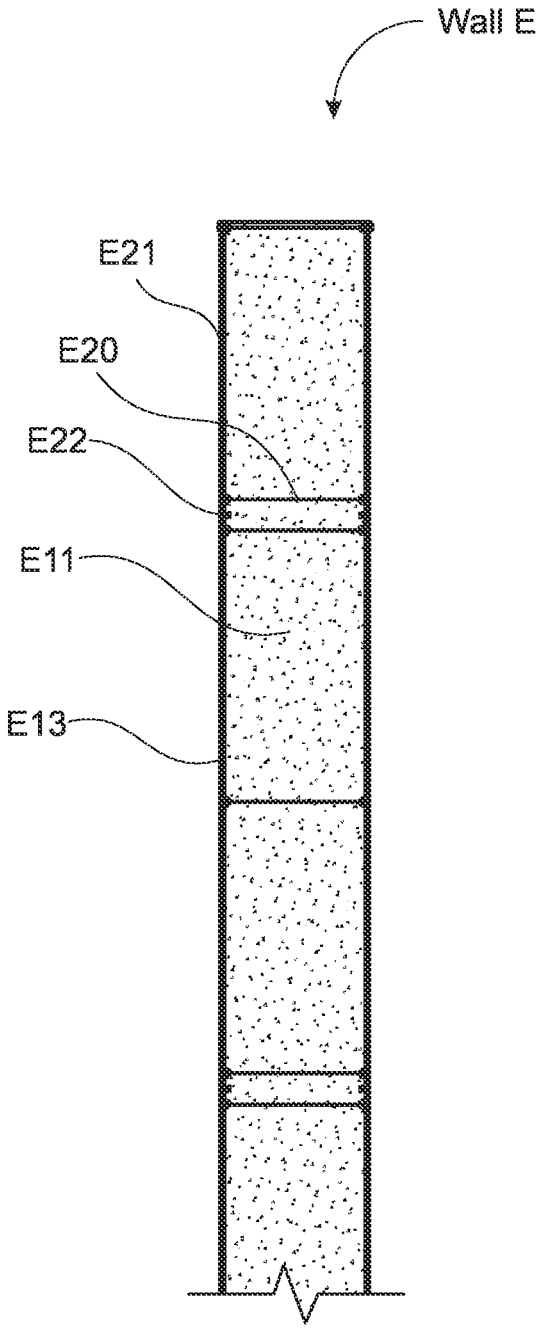
FIG. 3E is a view showing a horizontal section of the Wall E, in accordance with the fifth embodiment of the present disclosure.
Figure 3F:
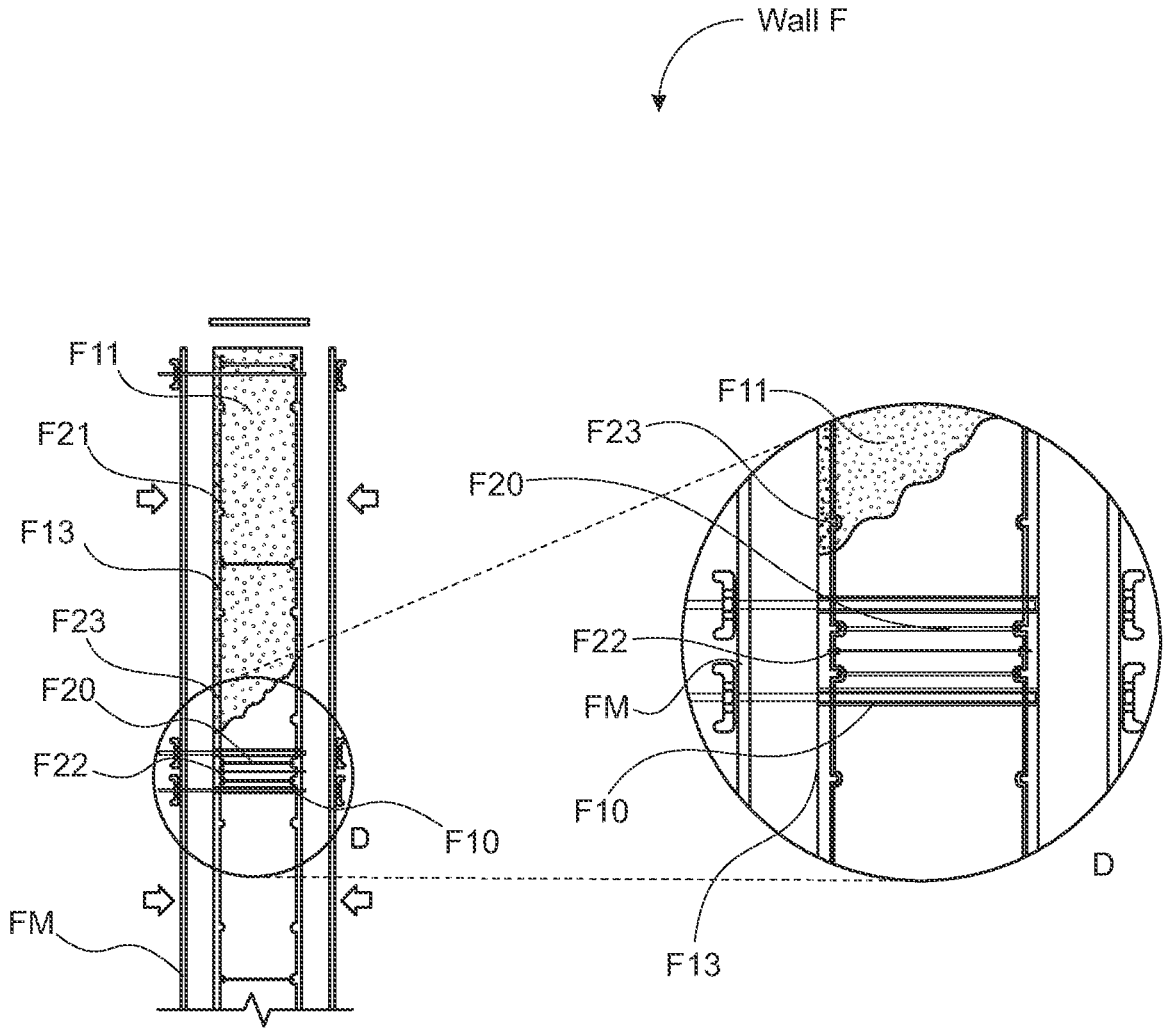
FIG. 3F is a view showing a horizontal section of the Wall F, in accordance with the sixth embodiment of the present disclosure.
Figure 4B:
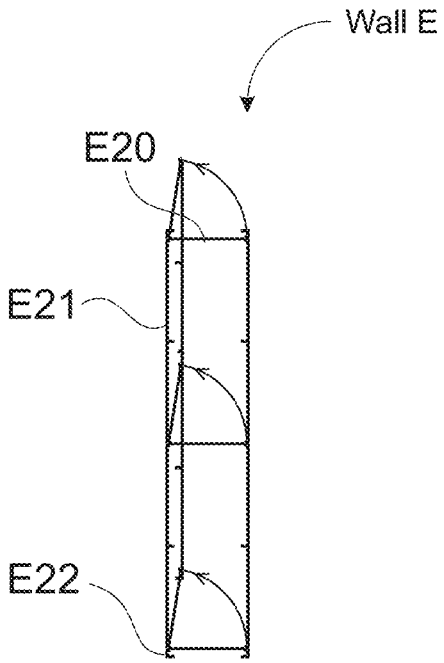
FIG. 4B is a view showing details of a typical module of the Wall E in different stages of folding, in accordance with the fifth embodiment of the present disclosure.
Figure 4C:
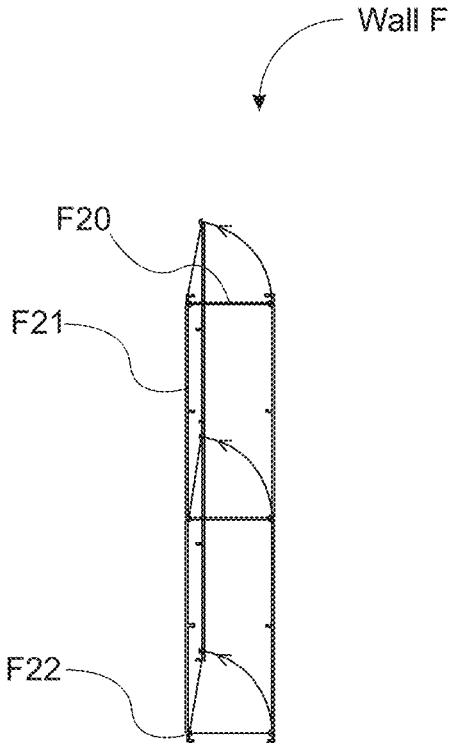
FIG. 4C is a view showing details of a typical module of the Wall F in different stages of folding, in accordance with the sixth embodiment of the present disclosure.

The alternative wall C, represented by FIGS. 1C, 2C and 3C, which shows the application of the present invention to a typical wall, but not exclusively, prefabricated wood, unique or cross-linked pillared; diagonals, chains or cross-linked.

The alternative wall D, represented by FIGS. 1D, 2D, 3D and 4A, showing the application of the present invention to a wall (or panel) prefabricated, typical but not only of metal structure, with single or continuous cross-linked pillars that allow the passage of the filling on the inside.

The alternative wall E, represented by the FIGS. 1E, 2E, 3E and 4B showing the application of the present invention to a wall (or panel) prefabricated folding, typical but not only of metal structure, with articulated pillars reticulated single or continuous to allow the passage of the filling on the inside.

The alternative wall F, represented by the FIGS. 1F, 2F, 3F, 4C, showing the application of the present invention to a wall (or panel) prefabricated, foldable, stackable, modulable, prefabricable and fillable in work; typical but not only of plastic, wood, PVC, glass fiber, carbon or metal structure, with articulated Interior elements fiber and cross-linked, single or continuous to allow the passage of filling Interior and side walls which form, in set, a supporting structure.

The alternative wall A represented by FIGS. 1A, 2A and 3A, showing the application of the present invention, a wall of individual pillars located on the axis of the wall. It is formed by pillars (A3) impregnated wood, metal, PVC or other material suitable for this use, arranged in the axis of the wall. The pillars (A3) are based on a foundation or support of a traditional Foundation (A1) or directly on plates of concrete (A2) which are of variable thickness and in the diameter of the concrete cylinders that distribute the loads to the bottom of the excavation.

The distance between pillars (A3) is determined by the needs of architecture and structural calculations. Horizontally, at the base of the wall and between the pillars (A3) it has a light plinth consisting of a block of expanded polystyrene, polyurethane or similar (A4) which aims to isolate the wall from the ground, preventing the rise of the moisture and also fulfilling the function of insulate thermally the construction, avoiding in this way the thermal bridge. This block of expanded polystyrene (A4) is given by the width of the wall to be built, and its high by the climatic characteristics of the area where the wall will be built.

Nailed horizontally and externally to the pillars (A3) at their top, bottom ends and eventually in its middle part with respect to its height and on both sides of the wall, bedplates (A5) and (A6) chains are. Diagonally to the pillars (A3) screeds (A5) and chains (A6) and both sides of the wall, laying strips or guardians (A8) that meet the purpose of triangular and stiffen the structure on exogenously to the axis of the pillars (A3). These slats or tutors (A8) nailed or fixed by either side of the wall, a vertical (A3*b*) supplies which are set on pillars (A3) equal measures than the screeds (A5) and chains (A6).

In the interior space given by the structure of pillars (A3) the chains (A6) bedplates (A5) and diagonal (A8) tutors and whose width will depend on the length of a separator element mold (A9) that will also define the thickness of coating of the slats or tutors (A8), is poured into work (A11) materiality and composition according to specification and insulation needs filling. This separator mold (A9) has sufficient resistant to support the compression element to resist the tightening bolts which unite both sides of the mold and pass through the tubes (A10) arranged next to the mold (A9) separator. A good choice to choose a separator is a piece of Ribbon or a guardian (A8). Separator (A9) is riveted or fixed to pillars (A3) chains (A6) and Base (A5) near tubes (A10) of equal length, which will pass through the bolts that are eventually the mold.

For the coating of the wall, is considered a stucco plated or melded lime (A12) on which is the final finish of the wall (A13).

Build the alternative A wall is the following: In excavations, depth according to particular calculation, are installed (directly in the background, on a cylinder of concrete of low thickness to distribute the loads (A2), a bench of Foundation (A1) or on a small bed of concrete, the pillars (A3) plumbed and apart according to architecture and structural design. It is convenient to first place the ends of the wall (A3) pillars so these serves as tie lines and place, plumbed and according to this layout, the rest of the pillars. Then horizontally and externally to the pillars, in its upper part, placed bedplates (A5) upper and middle stitch (A6); it is then placed, (A5) sill plates are placed between pillars (A3) the plinth (A4) and externally to the pillars (A3) on the level of the plinth (A4). Between pavers (A5) and (A6) chains are attached to the pillars (A3) supports (A3*b*) same or similar thickness as the chains (A6) and the base (A5). Formed frame it has a stiff looking, diagonally (A3) pillars and slabs (A5) and/or medium chain (A6) slats or tutors (A8), at a distance, wheelbase, between 0 and 30 centimeters, these slats (A8) will cover the plinth (A4) laterally and they reach the top or Coronation of the wall. It is important to place the slats (A8) contrary to both sides or ends of the wall to obtain an appropriate response to any solicitations of an earthquake, in both directions.

Depending on the specific structural calculation and the height of the wall, will be necessary to position one or more pairs of chains (A6) to shorten the separation between fixations of slats or light (A8). Is suitable the placement of ties (A7*b*) between slats (A8) from both sides of the wall, when the quality of the fixation of these (A8) to the supports (A3*b*) pillars (A3) and the chains (A6) is not guaranteed or the calculations indicate. It is also convenient to place an obstacle (A7) between the chains (A6) or screeds (A5) on both sides of the wall, thing that makes this lock attaches to work to cut and not the friction as it makes fixations of the chains (A6) to the pillars (A3) against solicitations that tend to disengage a base (A5) of the pillar (A3). In addition, this lock reduces the light between fixations of bedplates (A5) to the pillars (A3). Once revised levels and Plumb and also made anchors and connections with other walls, proceed to the placement of the mold, which commonly requires separators (A9) and ties (A10). Spacers (A9) are elements that are arranged perpendicular to the longitudinal axis of the wall, commonly in the same material and slats or tutors (A8) section and chains (A6) or screeds (A5) are attached to the pillars (A3) to define the width final covering of slats or tutors (A8) and consequently also of the padding of the wall (A11). Conveniently, beside these separators (A9) are placed, tied them (A9) to the pillars (A3) to the chains (A6), bedplates (A5) or slats (A8) tubes (A10) by where you will pass through the fastening element of the mold on both sides of the wall; element that is commonly a bolt, but that frequently and in traditional way is tortured wire, which withdraws after the setting of the wall (A11) stuffing mix.

With mold arranged on the wall in a definitive way, the spill is proceeds or stuffing mix (A11) to the inside of the wall. This filling (A11) is a mixture of clay mulch without or with additives and aggregates, such as beads of polystyrene, chip wood, saw dust, volcanic ash or mixture of materials that gives the desired characteristics and/or the isolation.

Settled once the mixing of filling (A11) to the inside of the wall, thing which needs less energy vibration of the required concrete—for the thrust over the mold is - produced, by breakdown of the materials heavier of the mix, the rise of free water to the upper surface of the wall, water drying with sponge or rags.

After the time of curing or drying filling (A11) which varies according to the thickness of the wall and conditions of temperature and humidity environment and to guarantee that already filling does not exert pressure on the mold, it can be removed and then a pa r of days of drying, and with the wall even with humidity, applies, directly on this, a plaster, patched and plaster (A12) molded that protects it from the moisture and gives it a finish. The recommended composition of the final plaster, of approximately one centimeter in thickness is cement, hydraulic lime and sand in approximate volume ratio is 1:1:6. This plaster once dry (A12), it is possible to paint, wallpaper or give any final finish (A13).

Alternative B wall: represented by FIGS. 1B, 2B, and 3B, showing the application of the present invention to a wall, commonly greater than 30 cm. wide, built by more than one pillar (pillar doubles, triples, etc.) cross-linked or arranged in such a way to allow the free passage of the stuffing to the inside of the wall. It is composed of cross-linked pillars (B3); impregnated wood, metal or plastic derivatives. The pillars (B3) are based on a foundation or support of traditional Foundation (B1) or directly on a plate of concrete (B2)

that distributes loads to the bottom of the excavation. The distance between pillars (B3) is determined by the needs of architecture and structural calculation and van arranged on shafts of the walls that form the building.

Horizontally, at the base of the wall and between the pillars (B3) has a traditional plinth concrete Bolognese or a plinth light (B4) consisting of a block of expanded polystyrene, or other insulating and resistant material to the humidity, which aims to isolate the wall from the ground, preventing the raise humidity and also fulfilling the function of insulate thermally the construction, avoiding in this way the thermal bridge. This plinth (B4) are given by the width of the wall to be built and the climatic characteristics of the area where the wall will be built.

From the top of the pillars (B3) ends of the wall to the bottom of the neighboring (B3) pillars are placed on the same axis or plane of the pillars (B3) diagonals (B14) strengtheners of the wall with their corresponding locks (B7) contributing to the rigidity of the structural joint, leaving plenty of room for, among them, to penetrate the filling (B11) to the inside of the wall when it is poured.

Externally the pillars (B3) and bias (B14) to all the high and both sides of it, horizontally and a distance approximately between 0 and 30 cm from other, fixed slats or tutors (B8) these slats or guardian (B8) as well as helping to the structuring of the wall, used to contain future filling the wall, once set.

In lieu of placement of diagonal strengtheners in the same lead of the pillars, in the case of walls of low thickness, in which the pillars are placed together or minimum distance, proceed in the same way as on A wall; i.e. placed screeds (A5) horizontal and externally to the pillars on the plinth and screeds in the crowning of the wall, plus a couple of horizontal chains (A6) to half the height of the wall; also supports (B3 b) are placed on the pillars of equal section screeds (A5) and (A6) chains in order to nail the battens (B8) diagonals to the pillars. In the same way, it is necessary place obstacles between slabs and chains on both sides of the wall, which, significantly, to prevent the separation of the bars on both sides of the wall against seismic loads.

In the interior space given by the structure of pillars (B3) the diagonal strengtheners (B14) and slats (B8) and whose width depends on the length of a separator element mold (B9) which will also define the thickness of the guardians, is poured on site the filling of materiality and composition according to specification and insulation needs. This mold (B9) separator is a sufficiently resistant to compression element to resist the tightening bolts which unite both sides of the mold and passing through the tubes (B10) arranged next to the separator. A good choice for separator (B9) is a piece of Ribbon or guardian (B8). Separator is nailed or attached to the pillars (B3) or chains (B6) or slabs (B5), near tubes (B10) of equal length, which will pass through the bolts that eventually the mold. The diagonal placement of these strips together and separating the chains forms a kind of beam that much helps the resistance against earthquakes in the solicitation to the bending of the wall Separator (B9) is riveted or fixed to pillars (B3) diagonals (B14) and/or slats (B8) near tubes (B10) of equal length, which will pass through the bolts that will consolidate the mold (but which do not form part of the wall).

For the coating of the wall, is considered a stucco patched or mixed lime (B12) which is the final finish of the wall (B13).

Build the wall B is the following: In excavations, depth according to calculation, are installed directly on your background and a plate of concrete (B2) or on a bench of Foundation or Foundation (B1) the pillars (B3) together, separated or cross-linked, plumbed and apart according to architecture and structural design. It is convenient to first place the ends of the wall (B3) pillars so that these serve as tie lines and place firmly and according to this path the rest of the pillars (B3). Then, from the top of the extreme pillars of the wall to the bottom of the neighboring pillars are placed, in the same axis or plane of the pillars (B3) diagonals (B14) of the wall, leaving enough space so that it penetrates, among them (B14) (B11) filling the inside of the wall when it is poured. Placed after all the pillars (B3) levels are removed and placed the upper slabs (B5); then it is placed horizontally, between pillars (B3) the plinth (B4) consisting of a block of expanded polystyrene, of measures determined by the needs of insulation and weather conditions. This plinth (B4) of EPS density according to calculation can be replaced by rocks, Bolognese, concrete or other material insulating and resistant to the humidity. Formed frame is stiff setting, horizontally and externally to the pillars (B3) and diagonal (B14) slats or tutors (B8) to a distance between axes, between 0 and 30 centimeters, these strips will cover the wall, including part of the plinth (B4). It is also possible, as in the case of the wall to place floor slabs (B5) and horizontal (B6) chains and tutors in diagonal form, thus replacing the Interior diagonals (B14), so that the only difference with this wall it would be in this wall B pillar (B3) would be matched or cross-linked and the thickness of the wall will be higher; This solution has better resistance to transverse thrust of the inner padding (B11) in fresh on rear mold, since State that the light between slats or tutors (5) is notoriously lower.

It is convenient to the placement of ties (B7) between slats (B8) on both sides of the wall, when the quality of the fixation of these (B8) pillars (B3) and the chains (B6) is not guaranteed or the structural calculation indicate. Once revised levels and Plumb and also made anchors and connections with other walls, proceed to the placement of the mold, which commonly requires separators (B9) and ties (B10). Spacers (B9) are elements that are arranged perpendicular to the longitudinal axis of the wall and commonly are made of the same material and slats or tutors (B8) section and are attached to the pillars (B3) or diagonals (B14) to define the wide end of the covering of slats or tutors (B8) and consequently also of the wall filling (B11). Conveniently, beside these separators (B9) are placed, tied to them (B9) and/or the pillars (B3) to the diagonals (B14) or slats (B8) tubes (B10) where will flow through the element of clamp or tie the mold between both sides of the wall; element that is commonly a bolt, but that frequently and in artisanal form is made with twisted wire, which is removed after the setting of the wall (B11) stuffing mix.

With mold arranged on the wall in a definitive way, the spill is proceeds or stuffing mix (B11) to the inside of the wall. This filler (B11) is a mixture of clay mulch without or with additives and aggregates such as: pearls of polystyrene, chip wood, saw dust, volcanic ash or mixture of materials that gives the desired characteristics and/or the isolation.

Once placed the mixture filling (B11) to the inside of the wall, as you need less energy vibration of the need concrete—by the both the thrust over the mold is—retail, occurs, by disintegration of the heavier materials of the mixes, the rise of water free to the top surface of the wall, water that can be dried with sponge or cloths.

After the time of curing or drying of the filling (B11), which varies according to the thickness of the wall and conditions of temperature and humidity environment and to guarantee that filling does not exert pressure on the mold, it can be removed. After a couple of days of drying, and with the wall even with humidity, applies, directly over this a plaster, plaster (B1) twisted slim that protects it from the humidity and it gives a finish end.

The recommended composition of the plaster or final plaster (B12) of approximately one centimeter in thickness is cement, hydraulic lime and sand, in the approximate ratio of 1:1:6 in volume. This plaster, once dry, you can paint, wallpaper or any final finishing (B13).

In the case described the walls A and B or others with the implementation of the present invention, it is possible to properly strengthen the mold, arrange the filling of form and composition known to the State of the art as Adobe or rammed earth, in compacted form and layered—in some places of little rain, saving the final lining (A12 & B12).

Alternative C wall: Represented by FIGS. 1C, 2C and 3C, shows the application of the present invention a wall typical but not exclusively prefabricated wood, unique or cross-linked pillared, chains and reticulated slab is formed by: wooden pillars (C3) impregnated, metal, PVC, polycarbonate and/or other derivatives that can be one-piece or cross-linked by diagonals (C7*b*) to allow the passage of filling (C11) to the inside of the wall and also the placement of pipes, ducts and conduits for the same, without need special drilling and generating savings of material. Also has cross-linked chains (C6) between pillars (C3) and the base and crowning of the wall, and eventually other (according to needs of calculation) to half the height of the same and always allowing the free passage of the filling material to the inside of the wall.

Bedplates (C5) above, in the case of prefabrication of this wall, constitute the main element of union sections or segments of this wall.

The distance between pillars (C3) of one piece or cross-linked with diagonal obstacles (C7*b*) is determined by the structural calculation. Horizontally, at the base of the wall, under the sill reticulated plate (C5) between the pillars (C3) and contained by a pair of slats (C15) in the base of the wall, has a lightweight (C4) plinth consisting of a block of expanded polystyrene foam polystyrene or similar, that it aims to insulate the wall from the ground, preventing the raising of humidity and also fulfilling the function of thermally insulate the building, avoiding also the thermal bridges. The measure, in width, this block of expanded polystyrene (C4) is given by the thickness of the filling of the wall (C11) to build and height, by the climatic characteristics of the area where the wall will be built. On the formed structure, a film of polyethylene or other impermeable material (C17) attached with hooks or glue as a moisture barrier, that prevents staining the siding; fixed using nails, screws or other appropriate fixing (C16) are arranged, for the exterior and the interior of the wall coverings (C12); These plates can be (which give a very rigid to the wall) or wooden planks placed diagonally to the pillars (C3), thus generating an excellent triangulation which provides high rigidity. Both coatings rigidify the wall in exogenously to the plane of the pillars (C3) avoiding the placement of Interior diagonal to allow the dumping of fill (C11) at work; In addition, these coatings (C12) serve as mold to contain emptied (C11) filling in work.

As measure of external protection, at the base of the wall is placed a coating of cement or other material resistant to water (C14) which is fixed to the sill plate (C5) and a bar (C15) elements that enclose and contain the plinth and also the pillars (C3) to provide secure a suitable.

On the inside of the wall, such as protection of the plinth and base, is the installation of a plinth (C18*b*) on the piece that joins the wall pavement (C19).

The way of construction of the wall C, is designed, preferred but not limited to, to have coating of wood or plate, is as follows: on a pavement, proper work in factory or field Inn, the pillars (C3) are set in one piece—or cross-linked prefabricated—with their respective obstacles (C7*b*) diagonal or horizontal, distanced and dimensions according to architecture and structural design to bedplates (C5) chains (C6) to which shall be fixed indoor and outdoor cladding (C12). These bases (C5) and (C6) cross-linked chains are located horizontally above the level of the plinth (C4) and in the middle and top of the wall and between pillars (C3); in the upper part of this chain wall becomes base (C5) corrida or continuous since not placed between pillars (C3) but about them and are used to join sections or segments of wall. Then, between pillars (C3) and under the base (C5) mesh bottom is placed the plinth (C4) expanded polystyrene and is then placed (C17) polyethylene on both sides of the film structure and before the installing the sheathing or plate (C12) to avoid the swelling and staining the siding; then, through the use of the chosen fastener (C16) attaches siding and the interior finish (C12) to bedplates (C5) chains (C6) pillars (C3) and strips of the plinth (C15). Both walls lining the wall serve as mold to contain the spill of the filling of wall (C11) materiality or composition according to the needs. "This dumping of fill (C11) is made by the upper part of the structure or a place predefined to half way up the wall, so allowing to decrease the initial pressure on the walls, and cure its filling (C11) giving greater cohesion to the mixture, avoiding the desclavado and deformation of the lining. It is suitable to shore up, mounting or reinforce the wall cladding as not to dry the filling material (C11) to prevent its deformation by the pressure exerted in fresh State, by using procedures already known of the State of the art.

Once poured the filling (C11) to the inside of the wall, it is convenient when this is mud with chaff, for example, to remove the excess of water that is deposited or "climbs" effect of segregation, to the top of the wall, with a sponge or cloth.

In the lower part of the wall is placed, similar to other alternatives for the application of the present invention, elements that protect the base of the same. Outside stands a plinth of fiber-cement siding or other material resistant to water (C14) and by the inner face of the wall, is placed at its base, an element of union to the pavement (C19).

Alternative wall D: represented by FIGS. 1D, 2D, 3D and 4A, showing the application of the present invention to a wall (or panel) prefabricated, typical but not just wireframe. It has pillars reticulated single or continuous form of V (D3) with perforations that allow the passage of the filling (D11) Interior and has ribs or stiffeners (D3*b*) to all the height of the wall in its union with inner lining (D12*i*) and abroad (D12*e*) that they are of the same material of the pillars and have thicknesses and resistance as calculating specific and particular and with perforations, type sieve, at the level of the upper and lower part of the wall to facilitate the departure and/or evaporation of excess water. These elements, together form a rigid, supporting and prefabricable structure. The pillar, reticulated single or continuous (D3) has holes that reduce it and reduce its weight and allow the free passage of the filling (D11) to the inside of the wall. The number and size of holes of this element, are determined by the specific structural calculations for its thickness and higher loads. Besides the components described, horizontally, at the base of the wall and between the triangular spaces defined by the element D3), has a plinth (D4) light consists of expanded polystyrene blocks, polyurethane or similar, has by I object to insulate the wall from the ground, preventing moisture to rise through the filling (D11) and also play the role of thermally insulate the building and avoid thermal bridges. The measures of this block (D4) are given by its height and the width of the wall to be built by the climatic characteristics of the area where the wall will be built. The interior finish and exterior (D12) in the base of the wall and its coronation, possess a reinforcement (D18) to support efforts that are produced by the load of beams on the wall and in the place of fixation of the wall to the floor or base. This wall has a finished (13) that is applied to the inner panel and outer panel (D12) once that has set the padding of the wall (D11).

The way of construction of the wall D, it is designed to be prefabricated and have a typical structure, but not only metal cladding, in its form or prefabrication methods may differ greatly, however their field installation is simple: on a floor (D1), typical plinth or slab, is attached to this wall, partition, or panel (depending on your measurements and resistance) via (D19) determined by calculation. This binding is made in a fold with reinforcement (D18), which owns the wall at its base, designed to withstand the structural calculation is indicated at every opportunity, for each thickness, height of wall and solicitations to which is exposed.

The dumping of fill (D11) within the wall is manual, mechanically, or by cement truck: is important to consider that while (D11) the stuffing mix is cool, the pressure on the walls of the wall can deform it, so it is advisable to make this work in two or more stages, depending on the height and type of filling (D11). Eventually is recommended the placement of a "shoring or temporary formwork", what is done in a very simple form with known state of the art solutions.

The final finishing of the wall (D13) in the case of the described alternative consists of a layer of filling, wall paper, paint or another, since it does not require necessarily a cementitious stucco.

Alternative to wall prefabricated E: represented by FIGS. 1E, 2E, 3E and 4B, shows the application of the present invention in a folding wall. It consists of modules of parallel vertical walls (E3) of natural material or synthetic for this use, and United together by articulated elements (E22); It has strengtheners and reinforcement ribs. To deploy these walls, they are cut to the final width of the wall. These articulated frame elements, as well as unite and separate both walls, collaborate with the structuring of the wall.

As this wall is like a Lego, foldable, modular and stackable, it saves space, facilitates the storage and saves transportation. In addition, it is refillable in work.

These modules have different systems of vertical fixing between contiguous, known sections of the State of the art. As a plinth, it has a block of expanded polystyrene, polyurethane, or similar (E4) which aims to isolate the wall from the ground, avoiding increasing the humidity and also fulfilling the function of thermally isolate the construction, avoiding in this way the thermal bridge. This plinth (E4) measures are given by the width of the wall to be built, and its high by the climatic characteristics of the area where the wall will be cons-trued. Possesses, in addition, stiffeners or ribs at its bottom (E18) and upper (E18*b*) for anchoring to the floor prior to the inside (E11) filling of the wall.

The way to construct the wall E, is as follows:

About base Foundation (E1) unfolds the prefabricated module (E21), setting to its final position (E20) articulated barriers between parallel walls of the wall. Insulating plinth (E4) is then placed at the base of the wall, which will have reinforcement (E18) necessary and incorporated elements of union to the pavement (E19). Then placed the wall in its final position according to previous path and its base is fixed to the pavement (E1) using anchor bolts, dowels or (E19) system adopted at every opportunity. Once a stretch of wall continues joining it vertically with which follows by brooches, clips or other element (E22) that take the vertical walls (E21) contiguous.

Once raised walls to fill in work item is placed, as is the case of the wall type, a temporary fixed or sliding formwork that has the function of preventing the deformation of walls or walls during the emptying of the filling (E11) to the inside of the wall and not removed until this (E11) filling of the wall to harden and strength and cohesion that will ensure that it does not deform or will affect the verticality and squareness of the walls surface of the wall (E12). Once you have the certainty of it enough cohesion in the padding of the wall (E11) temporary mold is removed and the wall is able to receive its final surface finish (E13). Filling (E11) to use and empty into the wall in a manual or mechanized mind will be a mixture of soil with the additive and/or added that provided and it will typically be with chaff mud or required according to the provision desired.

Alternative wall F: represented by FIGS. 1F, 2F, 3F and 4C, showing the application of the present invention a wall type Lego, Folding stackable, detachable and refillable in work. It is formed by blocks of lateral walls (F21) from natural or synthetic materials that are conditions of strength and durability sufficient and appropriate for this use. These blocks are formed, as well as their walls (F21) by elements articulated (F20) that bind them. These walls have vertical reinforcements and/or recesses (F23) that allow the rear placement of tensors that unite the upper slabs (F18*a*) with plates and half the base pavement (F1) or lower sill (F18); also has an insulating plinth (F4) and tubes (F10) that in addition to defining the wide end of the wall, allow the last tie bolts to a formwork.

This wall is mecano, folding and modular and stackable, space-saving, facilitates the storage and saves transportation. In addition, it is refillable in work.

The way to construct the prefabricated wall F alternative, is as follows: This wall rises, typically, on a foundation or slab traditional (F1). Once defined and drawn upon the foundation walls, slab or base (F1), attaches to this an element reinforced connector that serves as a hearth, through bolts, screws, or another fastening element calculated and designed for each model (F19). Meccano type blocks open or display setting to its final position articulated latches (F21) between parallel walls of the wall; contiguous be placed at the base of the wall insulating plinth (F4).

Once installed a stretch of wall is continuing vertically uniting it with which is followed by the placement clips or other vertical element (F22) that take the adjoining walls and horizontally, at its end, using a base It has the elements willing to tie to join vertical reinforcements (F24) which play the role of pillars, and vertical and diagonal structural reinforcements.

Vertically, this wall will be raised by fitting prefabricated blocks or joining them by brooches, clips or other elements specially designed for this purpose. His coronation has elements and fittings willing that they tie or join the vertical reinforcements (F24), which play the role of pillars or structural vertical and diagonal reinforcements.)

Once raised walls to fill proceeds to place a lag or temporary formwork that has the function of preventing the deformation of the walls or walls during the emptying of the filling (F11) to the inside of the wall and they will not be withdrawn until East filling (F11) the wall acquires a setting, resistance, and/or cohesion that ensures that it does not deform or will affect the verticality of the surface of the walls surface of the wall (F12).

Once sure of sufficient cohesion and/or drying and hardening of the padding of the wall (F11) the temporary shoring is removed and the wall is able to receive its final surface finish (F13). Filling (F11) to use and empty into the wall in manually or mechanically will be common, but not only, a mixture of soil with the additive and/or added that provided and, typically it will be with chaff mud or required depending on the desired delivery. The stated filling (F11) is made of layers, to avoid deformations and Furthermore, depending on the type of filler to use, to get a good cohesion of the mixes filling by vibration or compaction of the filling, using techniques known of the State of the art. Once it has reached with the filling to the Coronation of the wall, moving with the slip form and after a sufficient period of time to ensure the sufficient cohesion of its filling, withdraws the slip form and placed an element of crowning an Interior and exterior wall of the wall (as a sill or upper chain) caring for inside wall filling make, fundamental but not the only, element and material receiving loads transmitted the deck or upper floors. For the final finish of the wall (F13), are considered known solutions of the State of the art.

The invention claimed is:

1. A structural wall comprising:

two or more pillars, each pillar extending vertically from a respective foundation block at a bottom of the structural wall towards a top of the structural wall, the pillars spaced apart from one another along a length of the wall;

a first horizontal bottom plate fixed to a first side of the two or more pillars adjacent to the bottom of the structural wall;

a second horizontal bottom plate fixed to a second side of the two or more pillars opposite the first horizontal bottom plate, adjacent to the bottom of the structural wall;

a first horizontal top plate fixed to the first side of the two or more pillars adjacent to the top of the structural wall;

a second horizontal top plate fixed to the second side of the two or more pillars adjacent to the top of the structural wall;

vertical pillar supplements disposed on each of the first and second sides of the two or more pillars to stiffen the structural wall, the pillar supplements being substantially coplanar with the bottom plates and the top plates; and a first plurality of diagonal stiffening elements fixed to equally spaced locations along the first horizontal bottom plate and the first horizontal top plate;

a second plurality of diagonal stiffening elements fixed to equally spaced locations along the second horizontal bottom plate and the second horizontal top plate;

wherein the pillars, the bottom plates, the top plates, and the diagonal stiffening elements define an interior space of the structural wall configured to allow a filling mixture poured into the interior space adjacent to the top plate to reach the bottom plate.

2. The structural wall according to claim 1, wherein the first horizontal bottom plate is located above a level of the foundation blocks.

3. The structural wall according to claim 1, wherein the structural wall is a piece-assembled, foldable, modular and stackable structure.

* * * * *